US005541609A

United States Patent [19]

Stutzman et al.

[11] Patent Number: 5,541,609

[45] Date of Patent: Jul. 30, 1996

[54] REDUCED OPERATOR EMISSION EXPOSURE ANTENNAS FOR SAFER HAND-HELD RADIOS AND CELLULAR TELEPHONES

[75] Inventors: Warren L. Stutzman, Blacksburg; J. Randall Nealy, Christiansburg, both of Va.

[73] Assignees: Virginia Polytechnic Institute and State University; Virginia Tech Intellectual Properties, Inc., both of Blacksburg; Center for Innovative Technology, Herndon, all of Va.

[21] Appl. No.: 400,583

[22] Filed: Mar. 8, 1995

[51] Int. Cl.[6] ..... H01Q 1/24

[52] U.S. Cl. ..... 343/702; 343/792; 343/901; 455/89; 455/90

[58] Field of Search ..... 343/702, 790, 343/791, 792, 883, 878, 900, 901, 903, 876; 455/89, 90; H01Q 1/24

[56] References Cited

U.S. PATENT DOCUMENTS

| | | | |
|---|---|---|---|
| 4,811,421 | 3/1989 | Havel et al. | 455/69 |
| 4,860,024 | 8/1989 | Egashira | 343/702 |
| 4,963,879 | 10/1990 | Lin | 343/792 |
| 5,231,407 | 7/1993 | McGirr et al. | 343/700 MS |
| 5,276,277 | 1/1994 | Hightower et al. | 174/35 MS |
| 5,300,936 | 4/1994 | Izadian | 343/700 MS |
| 5,317,325 | 5/1994 | Bottomley | 343/702 |
| 5,335,366 | 8/1994 | Daniels | 455/89 |
| 5,336,896 | 8/1994 | Katz | 250/515.1 |
| 5,338,896 | 8/1994 | Danforth | 174/35 R |
| 5,374,937 | 12/1994 | Tsunekawa et al. | 343/702 |
| 5,440,317 | 8/1995 | Jalloul et al. | 343/792 |

FOREIGN PATENT DOCUMENTS

| | | |
|---|---|---|
| 516490 | 12/1992 | European Pat. Off. . |
| 2679086 | 1/1993 | France . |
| 5315822 | 5/1992 | Japan . |
| 2235588 | 7/1990 | United Kingdom . |

*Primary Examiner*—Hoanganh Le

*Attorney, Agent, or Firm*—Whitham, Curtis, Whitham & McGinn

[57] ABSTRACT

An antenna for a personal communication device designed for reducing RF emissions to a user's head and body comprises a single half-wave dipole antenna element mounted on the top of a telescoping rod such that the antenna element is raised above the user's head when the rod is extended. The rod is completely inactive and serves only to elevate the active antenna element above the user's head and away from the body. A built-in switch is provided which reduces the transmission RF power when the rod is retracted to further protect the user. In a second embodiment, a co-linear array of dipole antenna elements is used. The full array is active for reception. However, a proximity detector senses the proximity of a human body, and lowers the RF transmission power to those antenna elements in the array that are closest to the user's head.

14 Claims, 5 Drawing Sheets

REDUCED OPERATOR EMISSION EXPOSURE ANTENNAS FOR SAFER HAND-HELD RADIOS AND CELLULAR TELEPHONES

DESCRIPTION

BACKGROUND OF THE INVENTION

1. Field of the Invention

The present invention generally relates to antennas for reducing RF emission exposure to humans from hand-held radios and, more particularly, to antennas for reducing the electromagnetic emission hazards associated with cellular telephones.

2. Description of the Prior Art

In recent years there has been a proliferation of personal communication devices, such as, hand-held radios and particularly cellular phones. In addition, the next generation of personal communicators is anticipated to be even more pervasive than cellular telephones. Like all new technologies, the convenience of personal communication devices does not come without environmental consequences. Whether real or perceived, the headlines and recent medical reports have sparked fear and concern over the personal safety of users constantly exposed to electromagnetic RF emissions radiating from the antennas of their personal communication devices. Reports suggest that personal communication devices have been linked to head anomalies such as brain cancer, indicating the need to develop device designs for reducing harmful antenna emissions or at least diverting RF emissions away from the user's head and body.

Several designs have been proposed for cellular phones to reduce electromagnetic exposure. Most of these designs involve using some type of electromagnetic shield, such as, U.S. Pat. Nos. 5,335,366 to Daniels, 5,338,896 to Danforth or 5,336,896 to Katz. For example, Katz discloses an electromagnetic shielded jacket for encasing a cellular phone. Round openings are cut into the jacket immediately adjacent to the ear-piece and the mouth-piece to allow sound waves to freely pass. Doors are provided for allowing limited access to the control pad. After a telephone number has been dialed or some other control button depressed, the user can close the door to protect from any radiation that might be emanating from the control pad. Unfortunately, jackets such as this are cumbersome and not particularly compatible with the now popular flip-phone design where the mouth-piece is placed on a hinged door which flips closed when not in use to cover the control pad.

Furthermore, while the Katz jacket shields a user from RF emissions radiating form the body of the phone, a much greater health threat has been associated with the much higher emissions which radiates from the antenna. Katz addresses the antenna issue by installing atop the jacket a telescoping antenna which is hinged at the bottom so that it can be tilted away from the user's head. While this may reduce emissions to the head somewhat by swiveling the tip of the antenna away form the head, the base of the antenna remains the same distance from the head. This is unfortunate since the telescoping antenna is active and emits radiation along its entire length from tip to base. Furthermore, when the Katz antenna is swiveled away from the head, the tip and length of the telescoping antenna inadvertently move closer to the user's arm, shoulder, back or chest. Hence, swiveling the antenna accomplishes little more than partially displacing the health risk from one part of the body to another.

Other designs to reduce electromagnetic emissions to the user's head involve modifying the design of the antenna itself. For example, U.S. Pat. No. 5,231,407 to McGirr et al. discloses an antenna comprised of radiating patch elements completely inside of a portable telephone chassis. The near field of the antenna is such that radiation to the user's head is minimized. French Patent FR 2679086 to Matra Communications addresses the electromagnetic exposure problem by moving the telescoping antenna from the top of the hand set to the bottom. Again, while these alternate antenna designs may reduce exposure to the head, they inadvertently increase exposure elsewhere. In the McGirr et al. design, it seems that the user's hand or shoulder may receive elevated exposures. Similarly, in Matra Communications design, the user's neck and torso receive elevated doses of radiation. As a further drawback, for both designs, transmission and reception may suffer since a larger part of the user's body absorbs and blocks much of the antenna energy.

SUMMARY OF THE INVENTION

It is therefore an object of the present invention to provide an antenna for reducing electromagnetic emission exposure to the body of a portable radio user.

It is yet another object of the present invention to provide a portable transceiver antenna which decreases RF transmission power as a function of the proximity between the antenna and the user's body.

In a first embodiment, a standard telescoping antenna on a personal communication device is replaced with a single half-wave dipole antenna element or other similar balanced radiating element mounted on the top of a telescoping rod such that the antenna element is raised well above the user's head when the rod is extended. Although the telescoping rod resembles a conventional telescoping antenna, the rod is completely inactive and merely serves to raise the active antenna element well above the user's head and away from the user's body. In addition, a built-in switch is provided which switches to a reduced transmission power when the telescoping rod is retracted. That is, when the telescoping rod is retracted, a switch is activated that reduces the transmitted power to a safe level. When the antenna is fully extended, full power is radiated.

In a second embodiment, instead of a single radiating element as above, the active element of the antenna is a co-linear array of dipoles consisting of two or more elements in the array. The full array is active for reception; however, a proximity detector in the personal communicator senses the proximity of the user, and reduces the RF transmission power to those elements in the array that are closest to the user'head.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
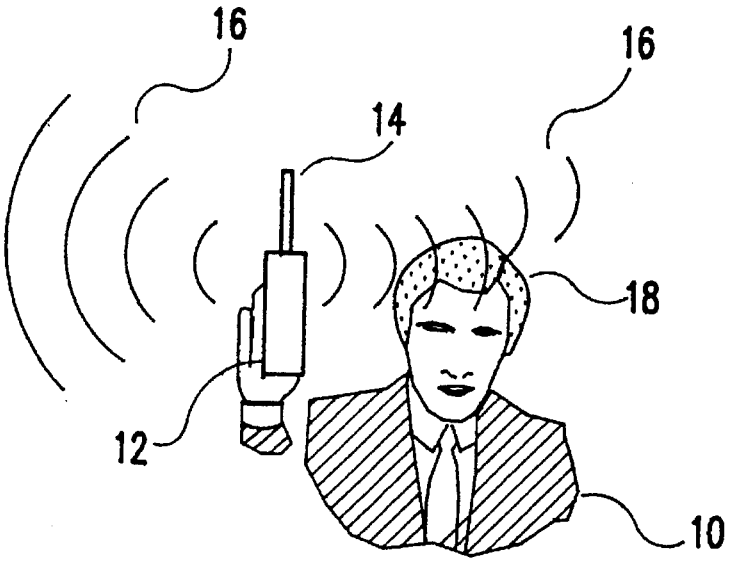
FIG. 1 PRIOR ART
FIG. 1 is prior art personal communication device showing the radiation pattern of a conventional telescoping monopole antenna.

Referring now to the drawings, and more particularly to FIG. 1, there is shown a user 10 using a personal communication device 12 having a conventional monopole telescoping antenna 14. It is understood that the term personal communication device includes devices such as cellular phones, walkie-talkies, or any other transceiver which employs an antenna proximate to the human body, and particularly the human head. As is immediately apparent, two main problems exist with regard to the RF radiation pattern 16 of the conventional antenna 14. First, medical evidence exists which suggests that the radiation entering the user's head 18 is a potential health hazard. Second, the RF radiation which enters the user's head 18 is partially absorbed or blocked thereby degrading transmission power, consequently performance and range suffer.

Figure 2:
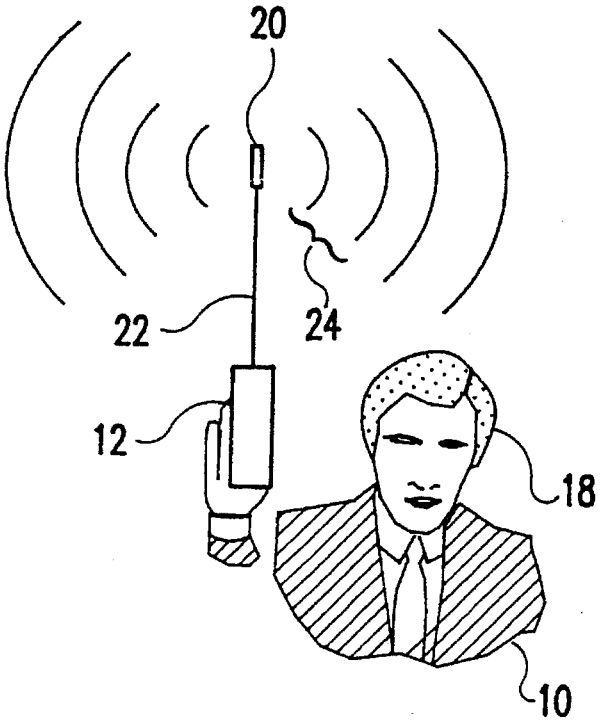
FIG. 2 is a personal communication device showing the radiation pattern of the half-dipole antenna mounted atop a telescoping rod according to the present invention.

FIG. 2 shows the same user 10 using a personal communication device 12 having the novel antenna structure according to the present invention. The antenna structure comprises an active antenna element 20 mounted atop a raised rod 22, preferably a telescoping rod. A desirable feature of this design is that the active portion of the antenna is extended above the user's head 18. The near field 24 of the active antenna element 20 is such that the user's body 10, and particularly the head 18, experience reduced RF radiation exposure. Additionally, as illustrated in FIG. 2 (and in the measured dam shown in FIG. 4B), little of the RF emission is blocked by the user's body thereby improving the range and performance of the personal communication device 12.

Figure 3:
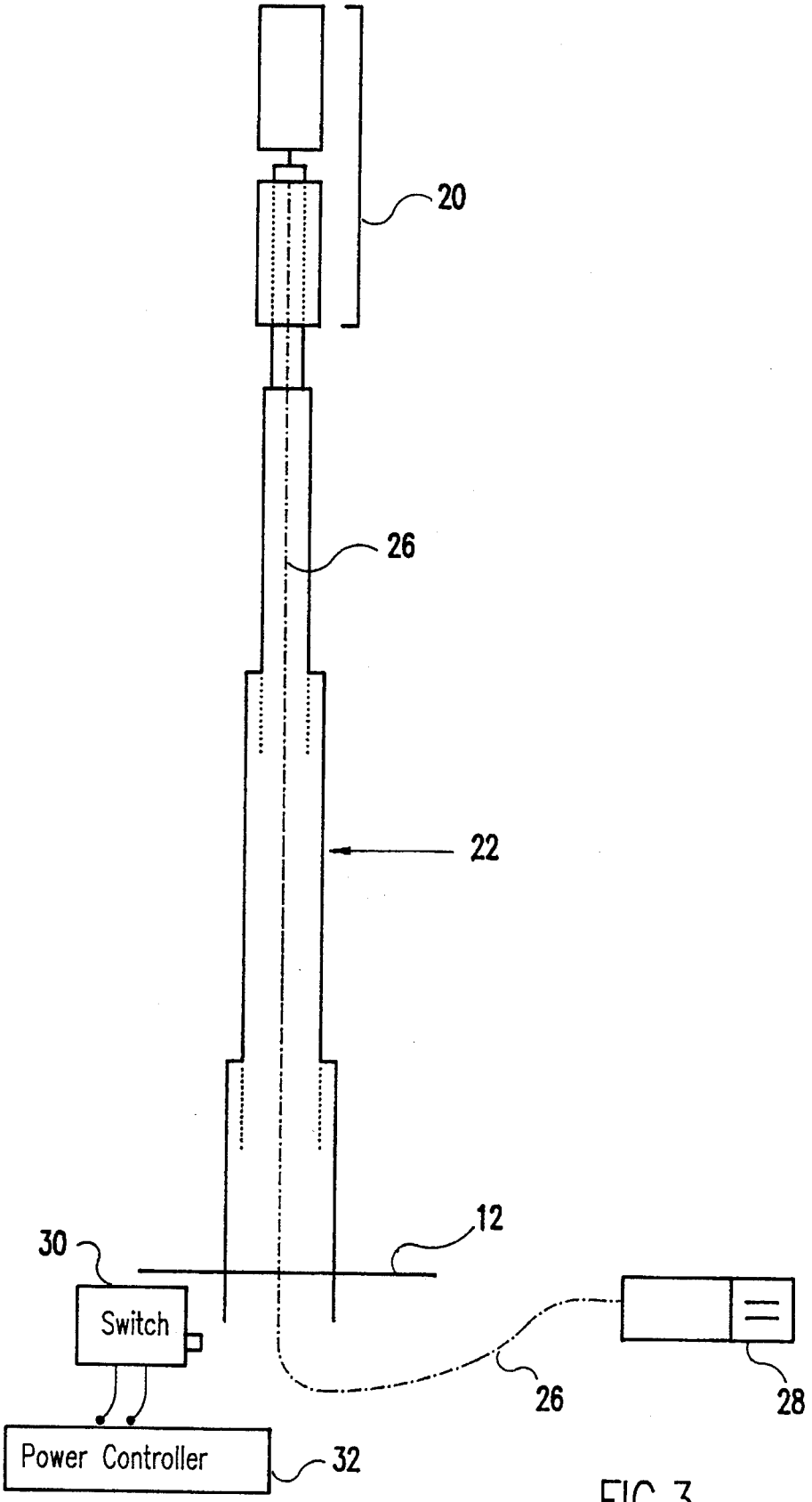
FIG. 3 is a block drawing showing the personal communicator antenna according to the present invention.

Referring now to FIG. 3, a half-wave dipole antenna 20 is shown mounted on top of a telescoping rod support 22. A coaxial lead 26 extends through the length of the rod support 22 and electrically connects the half-wave dipole antenna 20 to the transceiver components 28 of the personal communication device 12. As a further safety feature, a switch 30 connects to a transmission power control module 32. When the telescoping rod 22 is in a retracted position and the active antenna element 20 is close to the user's head, the switch 30 causes the power control module 32 to reduce the transmit power applied to the active antenna element 20. While in this condition the performance of the personal communication device 12 may be somewhat degraded, the user's head will be protected. In addition, the performance quality will remind the user to fully extent the rod support 22. The switch 30 may either cause the power control module 32 to vary power at discrete levels, or may act on a continuous scale smoothly varying the power applied to the antenna element according to antenna extension length.

Figure 4A:
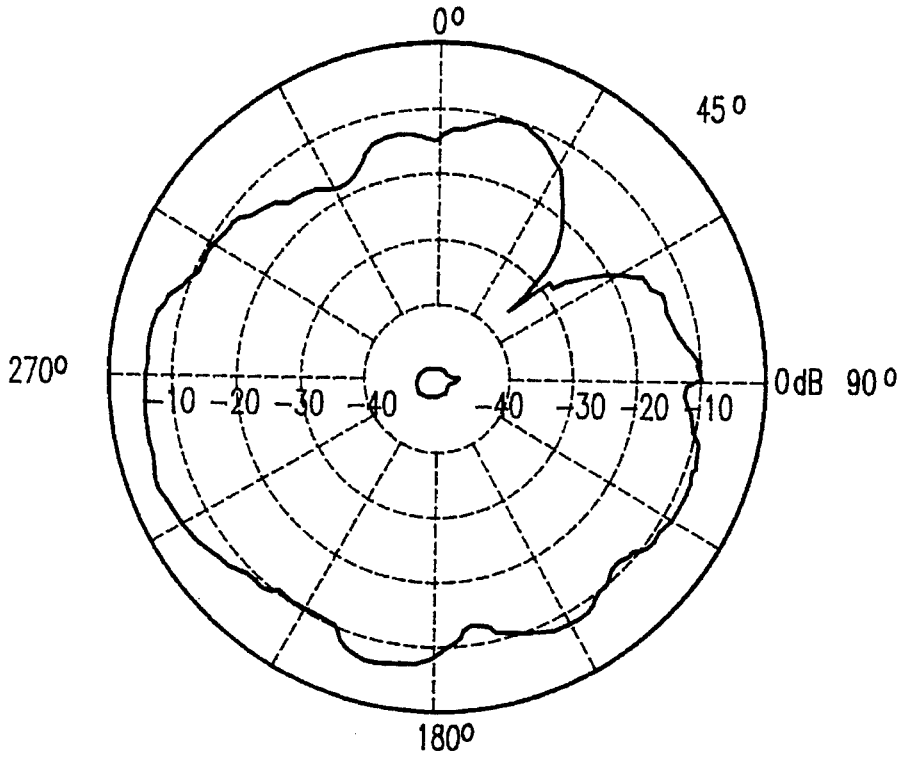
FIG. 4A is an antenna pattern for the telescoping rod in a retracted position.
Figure 4B:
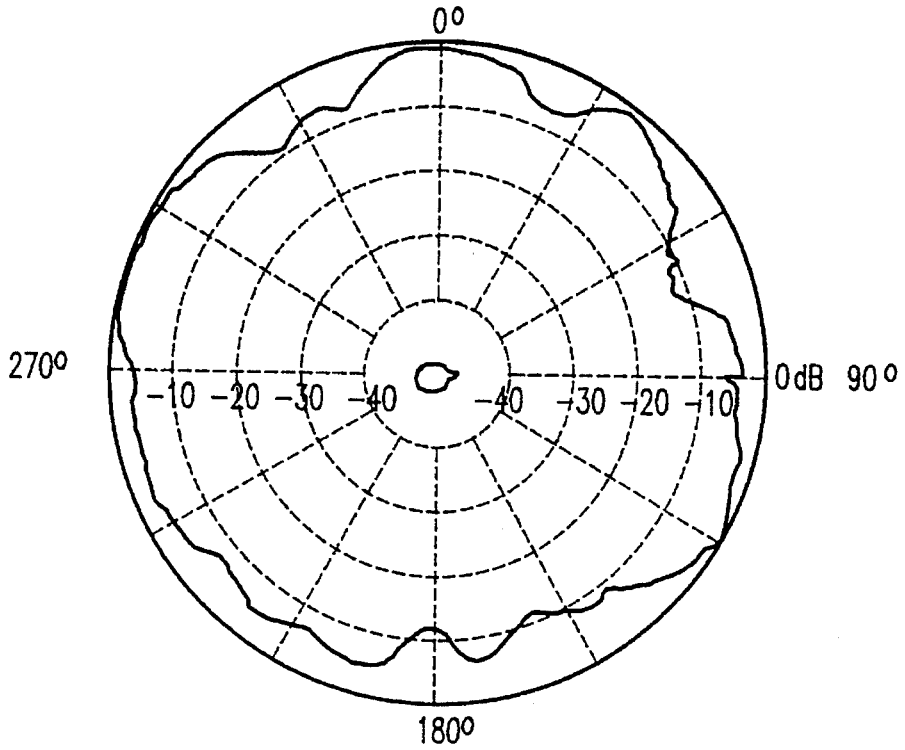
FIG. 4B is an antenna pattern for the telescoping rod in a fully extended position.

FIGS. 4A and 4B show test results using a human operator demonstrating that when the telescoping antenna is fully extended, performance is greatly improved and operator emission exposure is reduced. FIGS. 4A and 4B show the antenna pattern for the antenna of the present invention in a retracted position, and in an extended position, respectively. For comparison purposes, the transmitted power is the same in both cases. The patterns were measured at a 1900 MHz frequency holding the antenna at about a 45° angle tilt to the user's ear. As illustrated in FIG. 4A, the antenna radiates in all directions at a reduced power (about 6 dB lower than that shown in FIG. 4B) due to absorption by the operator. This is very similar to the way a prior art antenna, such as that shown in FIG. 1, behaves. A deep null appears in the radiation pattern of FIG. 4A at 45° due to absorption by the user's head. This greatly reduces performance and indicates significant emission exposure to the user. This is of course remedied by the present invention which operates at a reduced power when the antenna is in a retracted position. In FIG. 4B the antenna of the present invention is extended to about 28 centimeters with the radiating element above the user's head. The RF emissions are no longer blocked by the user's head, and is therefore substantially uniform in all directions (e.g. omnidirectional in the azimuth plane). Hence, emission exposure to the user is reduced while the performance of the communication device is improved.

Figure 5:
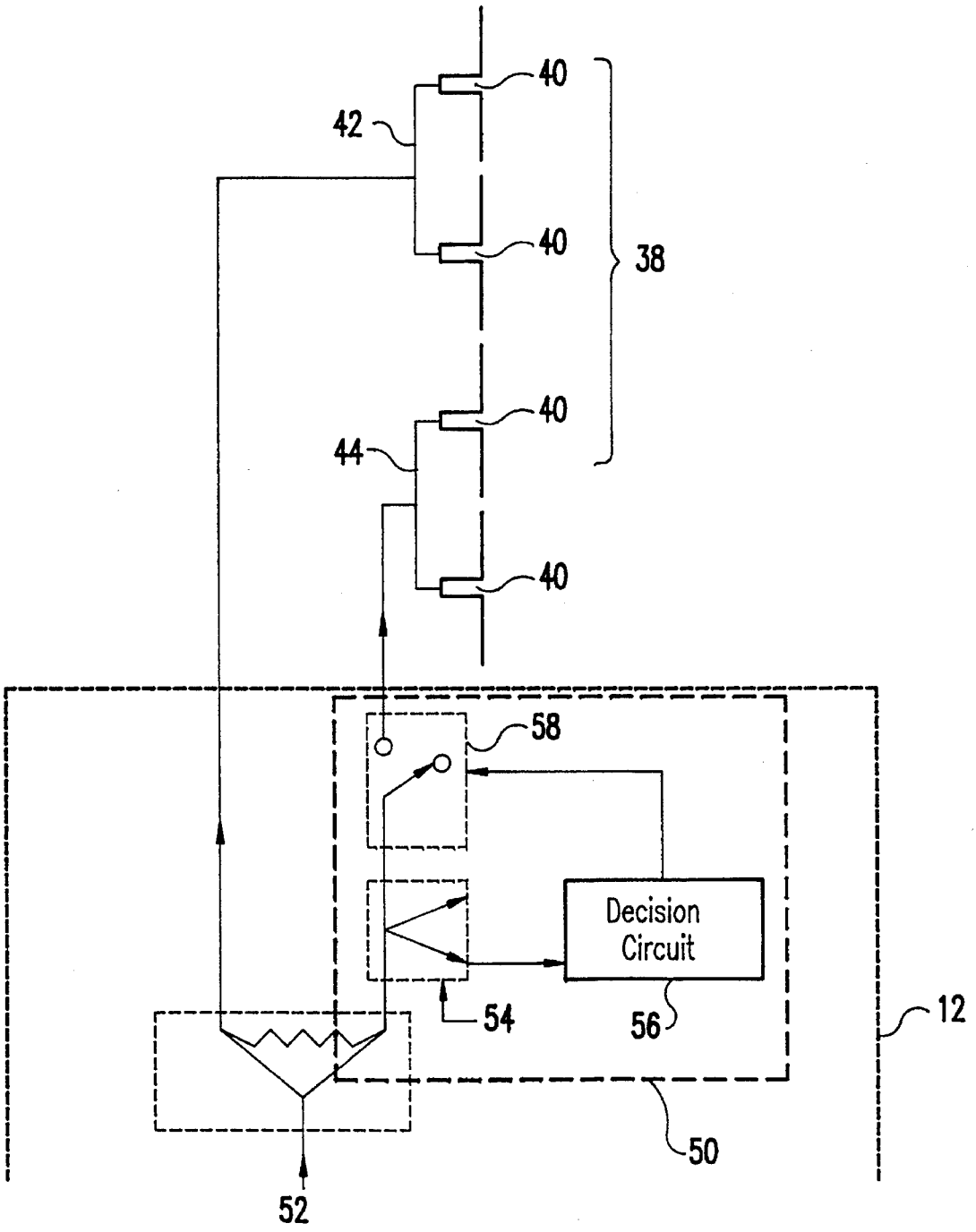
FIG. 5 is a block diagram of an alternate embodiment employing a dipole array and a proximity sensor.

Referring now to FIG. 5, there is shown an alternate embodiment for the present invention. Instead of using a single radiating element as discussed above, the active element of the antenna is a co-linear array of dipoles consisting of two or more elements in the array. In this particular illustration, the full array 38 consists of two arrays, 42 and 44, each comprising two active elements 40. The full array 38 is active for reception. However, for transmission, a proximity detector 50 attached to the transmitter 52 senses the proximity of a human body, and selectively reduces the RF transmission power to those elements 40 in the array closest to the user's head (not shown). Hence, the proximity detector 50 will act to reduce the transmission power from the lower elements of the array 44 since they are closest to the user's head. The proximity detector 50 comprises a directional coupler 54 attached to a decision circuit 56 which compares the output of the directional coupler 54 to a preset distance for the user's head. If it is determined that the user's head is in close proximity to the antenna array 38 a power control module 58 switches the lower array 44 to reduce the RF power in the proximity of the user's head. The power control module 58 may employ either a discrete switch or a continuous variable switch which varies power as a function of head proximity.

Figure 6:
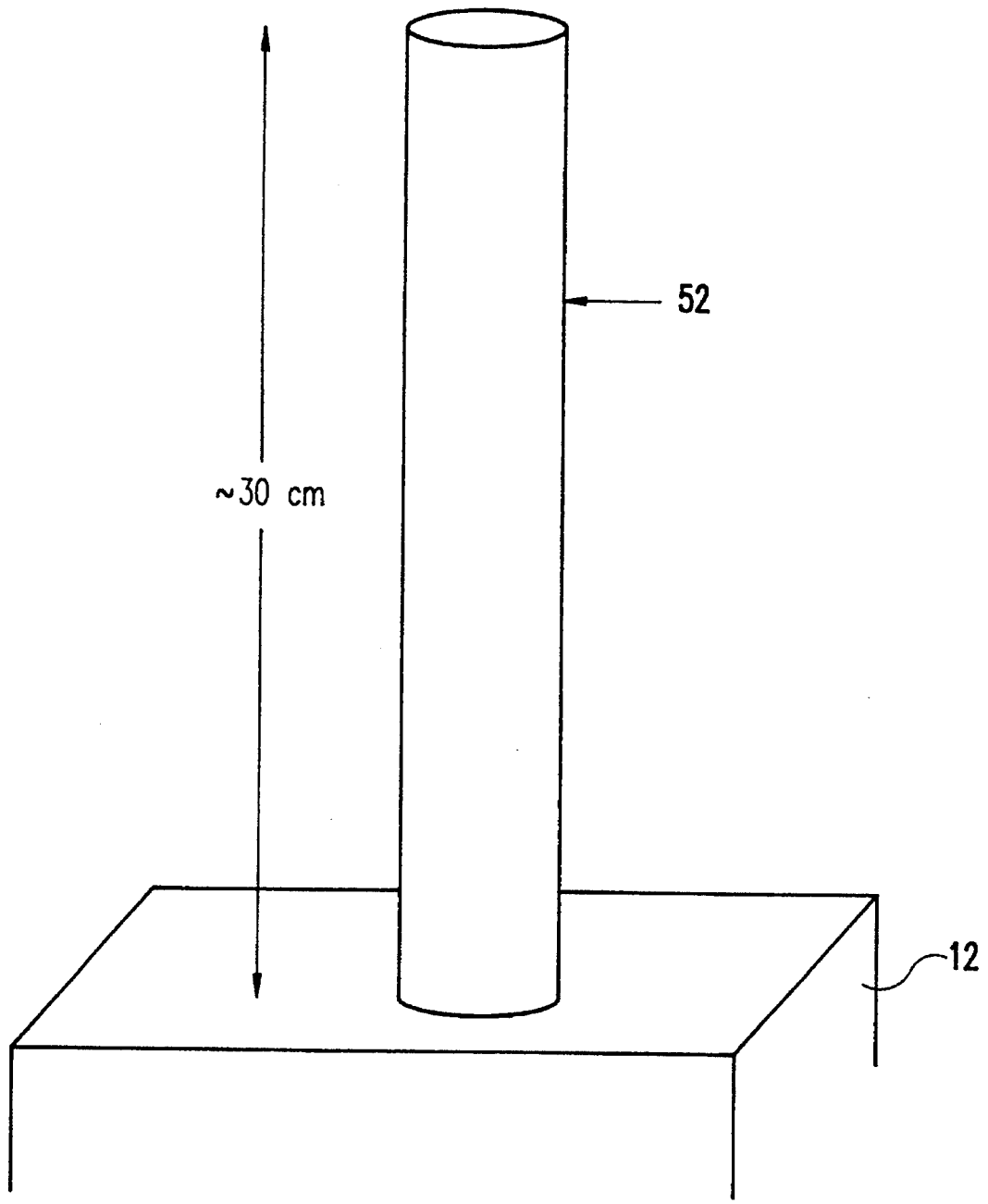
FIG. 6 is a diagram of the dipole array mounted within a flexible rod.

FIG. 6 shows the full array mounted along the length of a flexible rod 52 approximately 30 centimeters in length. However, it is noted that the array of dipole elements may take the form of many configurations and need not be limited to mounting on a rod. For example, the arrays may be mounted in a planar fashion within the chassis of the personal communication device.

While the invention has been described in terms of a single preferred embodiment, those skilled in the art will recognize that the invention can be practiced with modification within the spirit and scope of the appended claims.

We claim:

1. An antenna for a personal communication device for reducing RF emissions to a user, comprising:

a support rod suitable for mounting to a personal communication device;

an antenna element mounted atop said support rod;

a lead means for electrically connecting said antenna element to the personal communication device; and transmission power control means for reducing transmission power of the personal communication device when said antenna element is close to a user.

2. An antenna for a personal communication device as recited in claim 1 wherein said antenna element is a half-wave dipole antenna.

3. An antenna for a personal communication device as recited in claim 1, wherein said support rod is a telescoping support rod.

4. An antenna for a personal communication device as recited in claim 3, further comprising:

a switch means, connected to said transmission power control means, for detecting when said telescoping support rod is in a retracted position.

5. An antenna for a personal communication device as recited in claim 4 wherein said switch means is a variable switch.

6. An antenna for a personal communication device for reducing RF emissions to a user, comprising:

a support rod suitable for mounting to a personal communication device;

an antenna element mounted to said telescoping support rod;

a lead means for electrically connecting said antenna element to the personal communication device;

means for determining proximity between said antenna element and the user; and transmission power control means, connected to said means for determining proximity, for reducing transmission power supplied to said antenna element when said antenna element is close to a user.

7. An antenna for a personal communication device as recited in claim 6 wherein said antenna element is a half-wave dipole antenna.

8. An antenna for a personal communication device as recited in claim 6 wherein said antenna element is one of a plurality of discrete dipoles arranged in a co-linear array on said support rod.

9. An antenna for a personal communication device as recited in claim 6 wherein said means for determining proximity is an electronic proximity detector.

10. An antenna for a personal communication device as recited in claim 6 wherein said support rod is a flexible rod.

11. An antenna for a personal communication device as recited in claim 6 wherein said means for determining proximity is a switch.

12. An antenna for a personal communication device for reducing RF radiation exposure to a user, comprising:

an array of dipole antenna elements;

means for electrically connecting said array of dipole antenna elements to a personal communication device;

transmission power control means for selectively reducing RF transmission power to said array of dipole antenna elements; and means for determining proximity between ones of said array of dipole antenna elements and the user, said transmission power control means reducing RF transmission power to ones of said co-linear array of dipole antenna elements closest to the user.

13. An antenna for a personal communication device as recited in claim 12 wherein said array of dipole elements are mounted on a flexible rod.

14. An antenna for a personal communication device as recited in claim 12 wherein said array of dipole elements are mounted within the chassis of said personal communication device.

* * * * *